United States Patent [19]

Karnis

[11] 4,253,945

[45] Mar. 3, 1981

[54] HIGH CONSISTENCY PULP CLEANING

[75] Inventor: Alkibiadis Karnis, Quebec, Canada

[73] Assignee: Domtar Inc., W. Montreal, Canada

[21] Appl. No.: 65,463

[22] Filed: Aug. 10, 1979

[51] Int. Cl.[3] ..... B04C 5/08

[52] U.S. Cl. ..... 209/211; 162/55

[58] Field of Search ..... 209/211; 210/512 R; 162/55

[56] References Cited

U.S. PATENT DOCUMENTS

| | | | |
|---|---|---|---|
| 3,612,276 | 10/1971 | Lowe | 209/211 |
| 4,151,083 | 4/1979 | Dove | 209/211 X |

*Primary Examiner*—Ralph J. Hill

*Attorney, Agent, or Firm*—C. A. Rowley

[57] ABSTRACT

A method and apparatus for providing a cleaned stock issuing directly from a hydrocyclone cleaning system at a consistency of at least 1%, comprising injecting pulp to said hydrocyclone means at a consistency of at least 1%, said hydrocyclone having a tangential inlet for stock, a base outlet for an accepted fraction an apex outlet for a rejected fraction, and at least one dilution water tangential inlet adjacent to said apex outlet for dilution water, adding dilution water to said cyclone means through said dilution water inlet adjacent the apex outlet, rejecting a reject fraction through said apex oulet, and ejecting an accept fraction through said base outlet at a consistency substantially equal to said feed consistency.

5 Claims, 4 Drawing Figures

HIGH CONSISTENCY PULP CLEANING

FIELD OF THE INVENTION

The present invention relates to cleaning wood pulp, more specifically the present invention relates to a method and apparatus for cleaning pulp using a hydrocyclone means to provide a cleaned pulp of higher consistency than heretofore was directly available from hydrocyclone while retaining the cleaning efficiency of the cleaner.

PRIOR ART

In the cleaning of pulp it is normal practice to screen the pulp into an accepted and a rejected fraction. The accepted fraction is cleaned in centrifugal type cleaners, such as those sold by C E Bauer under the Trademark "Centricleaner" using several stages of cleaning. The cleaned stock (accepts) from the Centrifugal cleaning system (cleaners) are thickened and fed to storage.

Low consistency pulp (about 0.6% or less) is fed to the cleaners and an accepted stock fraction at a consistency approximately the same as the feed is produced. The accepts thus require significant thickening before they are stored at say at 3-4% consistency.

In the pulp and paper industry it has been deemed essential to operate the cleaners with an infeed below about 0.6% consistency if efficient operation of the cleaners is to be obtained. In many operations this requires the addition and/or removal of significant quantities of dulition water and energy consumed pumping these low consistency stocks is significant.

It is also known to add dilution water to a cleaner adjacent to the apex (reject) outlet thereof to permit the reject consistency to be significantly higher without plugging of the cleaner. For example, U.S. Pat. No. 3,785,489 issued Jan. 15, 1974 to Frykhult or U.S. Pat. No. 3,754,655 issued Aug. 23, 1973 to Troland both of which teach the use of added water to improve the efficiency of the cleaners and reduce the concentration of the fraction through the reject outlet (apex outlet).

It is also been proposed in the use of hydrocyclones for separation of slime from fine solids to add water to the hydrocyclone, see U.S. Pat. No. 2,829,771 issued Apr. 8, 1958 to Dahlstom. The dilution water addition means of the patent is similar to the dilution water addition intended for use with the present invention but is related to the mineral industry and is used with different feed materials on large diameter cleaners (base diameter 30 inches) and having steep cone angles (about 30°). This teaching cannot be extrapolated to the pulp and paper industry.

BROAD DESCRIPTION OF PRESENT INVENTION

Broadly the present invention relates to a method for cleaning pulp comprising pumping a pulp slurry at a pumpable consistency of at least 1% (preferably 1 to 2.5%) to a hydrocyclone means, rejecting a reject fraction through an apex outlet means of said hydrocyclone means adding dilution water tangentially to said cyclone means adjacent said apex outlet, ejecting an accept fraction through an axial base outlet of said hydrocyclone means at a consistency substantially equal to said feed consistency said dilution water being added to insure the consistency of said reject fraction does not exceed 1.1% and that said pulp slurry is classified with an efficiency substantially equivalent to that obtained using a similar cleaner at a feed consistency of about 0.6% but without the addition of dilution water. In the preferred arrangement the rejected reject fraction is further diluted preferably to a consistency of less than about 0.6%, cleaned in a second hydrocyclone means and the accepts from said second hydrocyclone means returned to form part of the feed to said hydrocyclone means. In some arrangements two high consistency cleaning steps (with dilution water added near the apex) may be arranged in series followed by low consistency cleaning.

Broadly the cleaner of the present invention comprises; a conical section having a tangential inlet means for feeding a pulp suspension substantially tangentially into said section, a base having axial base outlet for an accepted fraction and an apex outlet for a reject fraction at the end of said conical section remote from said base outlet; said base having a diameter of between 3 and 15 inches the cone angle of said conical section being no greater than 12° and no less than 3°, the action of said pulp suspension as it traverses said cleaner automatically defining a line of zero axial velocity in said conical section, at least one tangential dilution water inlet through said conical section adjacent but spaced from said apex outlet, a side of said tangential dilution water inlet adjacent said axis of rotation being substantially no closer to the longitudinal axis of said conical section than said line of zero axial velocity in a manner to insure dilution water injected through said dilution water inlet dilutes stock in the region between the line of zero axial velocity and the periphery of said conical section, said tangential dilution water inlet being dimensioned to inject dilution water at a velocity substantially equal to the velocity of the stock in said cleaner at said dilution water inlet and in an amount to ensure that the reject fraction is at a consistency of no greater than 1.1% when the pulp suspension fed thereto is at a consistency of at least 1%, the distance between said plan of entry and said apex outlet providing a dilution zone of an axial length sufficient to maintain the cleaning efficiency of said cleaner substantially equivalent to that obtained when dilute pulp of about 0.6% consistency is fed to a similar cleaner with no dilution water added.

BRIEF DESCRIPTION OF THE DRAWINGS

Further features, objects and advantages will be evident in the following detailed description of the preferred embodiments of the present invention taken in conjunction with the accompanying drawings in which.

DESCRIPTION OF THE PREFERRED EMBODIMENTS

Figure 1:
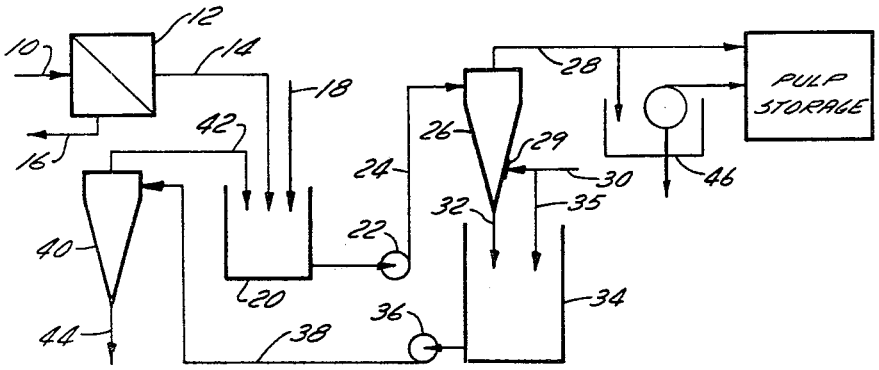
FIG. 1 is a schematic flow diagram of one application of the present invention.

As above indicated the present invention relates to a combination adapted to provide a hydrocyclone accept fraction having a consistency higher than 1% and generally closer to 2%. Referring to FIG. 1, pulp enters the system via line 10 and is screened by screening device 12 to form accepted fraction exiting via line 14 and a rejected fraction exiting via line 16. The rejected fraction is returned for further processing in a manner consistant with the particular pulping process involved.

Generally the screen accepts in line 14 will be about 2% consistency and in any event higher than 1% consistency and under normal practice dilution water would be added as indicated by the line 18 so that the consistency in the tank 20 would be reduced to about 0.6% or less. The maximum consistency while retaining cleaning efficiency varies with the type of pulp being cleaned but it will generally be retained at about 0.6% consistency. However, with the present invention no dilution water need be added and the consistency in the tank 20 will generally be substantially the same as the consistency in the line 14 (between 1 and 2.5%). Pulp at this consistency then passes to the primary cleaners 26 via the pump 22 and line 24.

The primary cleaners 26 are conventionally operated at a reject rate of about 20–40% of the feed and the cleaned accepts leave the primary cleaners via line 28 at a consistency substantially the same as the feed consistency (ie the consistency in tank 20 and line 24).

Dilution water is added tangentially to the cleaners 26 adjacent the apex of the conical section through a dilution water inlet 29 via the line 30 and the rejects leave the primary cleaners 26 via the apex outlet and line 32 to a tank 34. These rejects may be diluted to the desired consistency in tank 34 by dilution water entering via line 35. Conventionally the consistency in tank 34 would be approximately 0.5 or less for efficient cleaning or alternatively a second stage similar to the first stage may be used in which case dilution water from line 36 is not required. These cleaning operations may be followed if desired by a further stage at low consistency (0.5% or less). In any event pulp from tank 34 will be passed by pump 36 and line 38 to the next bank of cleaners 40 wherein the accepts from these cleaners (assuming no further cleaning stage) is passed back to the tank 20 via line 42 while the rejects leave the system and may be sewered via line 44 or otherwise processed. If a tertiary system is used the accepts from the second stage returned a feed to the first stage and the rejects from the second stage will be further cleaned in the third stage with the accepts from the tertiary stage will be returned as feed for the second stage.

The consistency of the pulp in line 42 will be lower than the consistency in line 14 but the quantity is such that consistency in the tank 20 will not be reduced significantly (ie the consistency in tank 10 will remain substantially the same between 1 and 2.5%).

As above indicated the consistency of the accepted pulp from the primary cleaners line 28 is about equal to the feed consistency in the line 24, normally will be between 1 and 2.5% (depending on the feed in tank 20). In some cases this consistency may be sufficiently high to warrant simply feeding directly to storage. However, in other cases it may be desirable to pass this cleaned stock through the thickeners generally indicated at 46. The thickener 46 is always used with conventional cleaning as the consistency in line 28 from a conventional cleaning system would be about 0.5% or less and it would be necessary to thicken before it could be stored. In any case, the normal thickened consistency of pulp for storage would be about 3 to 4% and under such conditions the minimum the present invention would do is to reduce the thickening capacity requirements by about 50%. Obviously this reduction in thickener requirements provides a very significant saving in any new installation and would permit an increase in overall production of existing systems without requiring a substantial capital expenditure for additional thickening equipment.

Figure 2:
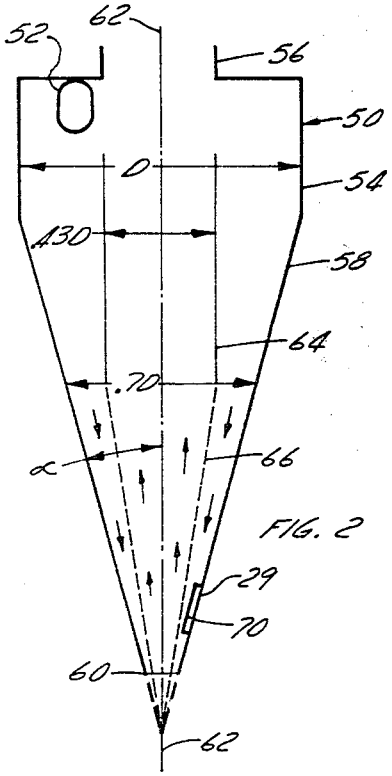
FIG. 2 is a schematic representation of a typical hydrocyclone with the present invention schematically applied thereto.

FIG. 2 illustrates a typical cleaner 50 having a a tangetial stock inlet 52, a base section 54, a base outlet 56 that is substantially axial of said cleaner, a conical section 58, an apex outlet 60.

The present invention requires the base diameter D be between 3 and 15 inches, if the diameter is too large the device will not operate properly and similarly if it is too small the capacity will be reduced and the effectiveness of the present invention will be totally lost.

The cone angle i.e. the angle between the inside surface of the conical section 58 and the axis 62 of the cleaner as indicated by the angle when operating in accordance with the present invention will never exceed 10° and generally will not be less than 3° and preferably will be between about 5°–70°.

The stock inlet 52, base outlet 56 and apex outlet 60 must be coordinated to obtain the desired reject rate from the apex outlet 60.

According to accepted theory of the operation of a hydrocyclone there is a downward velocity component adjacent the side walls of the cleaner and an upward velocity component adjacent the axis of the cleaner. Thus, there is a locus of zero axial velocity in the cleaner. This locus has been indicated in FIG. 2 by the solid line 64 which indicates what is generally referred to as the mantle of the cleaner and by the dotted line 66. This locus of zero axial velocity is symetrical with axis of the cleaner. The mantle is theoretically considered to have a diameter of about 0.43D where D is the diameter of the base and terminates at its end closest to the apex outlet 60 at the inner cone diameter equal to about 0.7D. The conical section 66 of the locus of zero axial velocity is a frustro conical section terminating at the apex outlet of a conical section extending from the end of the cylinder mantle adjacent the apex outlet 60 to the apex of the cone formed by the conical section 58.

In the operation of a cleaner the material that traverses the locus of zero axial velocity from the outside of the cleaner towards the inside of the cleaner is carried towards the base outlet.

In carrying out the present invention, the tangential dilution water inlet 29 has a side 70 adjacent the axial centre line 62 of the cleaner. This side 70 should not extend substantially beyond the locus 66 or a significant portion of the dilution water will pass upward in the upflow. It is generally preferred to maintain this dimension no greater than the distance between the inside of the wall of the conical section 58 and the locus of zero axial velocity 66. The inlet 29 must be positioned to ensure that the concentration in the downward flow outside of the locus of zero velocity is not as high as 1.1% since at consistency above 1.1% the cleaning efficiency of the cleaner is substantially reduced. The dilution water injected through inlet 29 (or inlets 29, assuming that more than one are present) must dilute the consistency of the stock to ensure that the reject fraction issuing from the outlet 60 does not exceed 1.1%. Thus the amount of liquid added will depend in part on the position of the inlet 29 since it must maintain said concentration to the apex outlet 60. The size of the inlet 29 i.e. actual cross-sectional dimension bearing in mind that the side 70 should not extend beyond the locus of zero velocity 66, must be coordinated so that the velocity is substantially equal to that of the stock at the place of entry of the dilution water and the quantity of dilution water added is sufficient to ensure that the rejects through apex outlet 60 is at a consistency no greater than 1.1%. This will in many cases require several inlets. Knowing the quantity and velocity one can then calulate the size of the dilution water inlet required to obtain the required flow. The further up the cleaner (away from the apex outlet) the inlet 29 is located the more water that normally will be required for a given reject rate, however the inlet must be spaced from the apex an axial distance sufficient to provide an axial length of diluted stock from the point of entry to the apex outlet to insure adequate time for the separation to occur so that the cleaner will maintain a cleaning efficiency for removal of unwanted materials substantially the same as is obtainable processing the pulp at low consistency (about 0.6%) without dilution water added.

Figure 3:
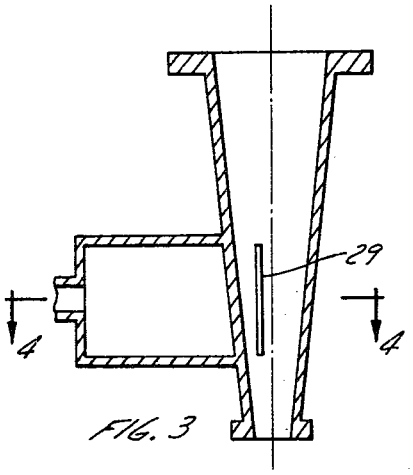
FIG. 3 is a section of the tip of a typical cleaner incorporating the present invention.

In the tests described in the following examples the primary cleaners were modified in the manner illustrated in FIGS. 3 & 4 but with two diametically opposed dilution water inlets 29. The particular cleaner used was a 6 inch base diameter (D) Centricleaner having a cone angle of $5\frac{1}{2}°$, a base outlet of 2 inch diameter, a tangential inlet of $1\frac{1}{2}$ sq. inch and tips sizes to form apex outlets of $\frac{3}{4}$ inch to $1\frac{1}{2}$ inch diameter depending on the desired reject rate. In one specific cleaner used the tangential dilution water inlet 29 was spaced from the apex outlet by approximately 2 inches (for $1\frac{1}{2}$ inch diameter apex outlet) and was in the form of a slit through the wall of the cleaner and located in a plane defined by the axis of the cleaner and the slit. The slit was 4 inches long by $\frac{1}{8}$ inch wide. Dilution water entered the cleaner tangentially as indicated in FIG. 3 with movement in the same direction as the liquid in the cleaner. The same size slit was used and when the tip size was changed to change reject rate it will be apparent that its position relative to the apex outlet changed when tips were changed to adjust the size of the apex outlet.

The specific dimensions given above are not absolutely essential to the operation but have been found to be very satisfactory with that particular size of cleaner operated under the conditions defined herein below in for example I. Should the size of the cleaner vary the size or the operating conditions change significantly the position of the tangential dilution water opening may be changed slightly for most efficient operation.

The dilution water must be added adjacent the apex outlet but spaced therefrom to provide a diluted zone of axial length sufficient for separation to occur yet not so high up the cone to be rendered ineffective in improving the cleaning operation. Similarly if it is too low (too close to the apex outlet) it will simply spray out the apex opening.

The dilution water should be added at substantially the same speed as the speed of the liquid in the cleaner i.e. the tangential inlet velocity should be approximately equal to the tangential velocity of the liquid spinning in the cleaner. If there is too great a differential between these velocities, the operation of the cleaner will be interferred with. Obviously, if the operating pressure of the cleaner is changed, there may be a slight change in the velocity of the liquid entering and exiting the cleaner which could necessitate a minor change in the size of the inlet for dilution water so that the quantity and velocity of the dilution water added remains within the desired limits. It is apparent that the slit opening illustrated extends over areas of different tangential velocity of the material in the cleaner, however, this has not been found to be particularly detrimental. The rectangular slit used as the dilution water inlet is to a degree self compensating i.e. the velocity changes along its length since the pressure along the wall of the cleaner varies thereby changing the back pressure of the tangential inlet.

The amount of dilution water added depends on the consistency of the feed and the size of the underflow opening, the location of the tangential dilution water inlet and the operating conditions. Substantially all of the dilution water added exits through the apex outlet and thus functions to dilute the cleaner rejects. It is important to maintain the cleaner rejects at a consistency of no higher than about 1.1%, preferrably the consistency about 1% or lower and sufficient water to maintain the consistency at the apex outlet must be added.

EXAMPLE 1

Figure 4:
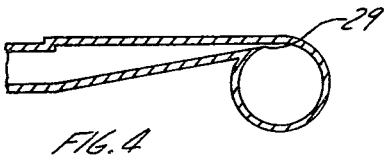
FIG. 4 is a sectional along the lines 3—3 of FIG. 3.

A 6 inch diameter hydrocyclone having an overflow (base or accepts outlet) diameter of 2 inches, a tangential feed inlet area of $1\times1\frac{1}{2}$ inches, an apex (reject) outlet of 1 diameter and a cone angle of $5\frac{1}{2}°$ was modified substantially as illustrated in FIGS. 3 and 4, however, instead of a single dilution water inlet 29, two such inlets in substantially diametrically opposite positions were used. The pressure drop across the hydrocyclone was maintained at 45 psig and the throughput was 150 U.S. gallons per minute at a stock temperature of 20°. The unit was operated with and without dilution water and at different feed consistencies using a mechanical pulp and the results of the operation are indicated in Table 1 hereinbelow.

The rate of addition of dilution water was 22.5 U.S. gallons per minute per slit (total 45 U.S. gallons per minute) and the tangential inlet water velocity was calculated to be 86 ft. per minute (4.4 meters per second).

It will be apparent that with a low feed consistency as normally utilized in cleaners namely a feed consistency of 0.55% and no dilution water, i.e. a conventional operation of a primary hydrocyclone, the efficiency of debris removal was 43% and of the low specific surface fibres was 39%. When the consistency of the feed is increased to 2% the removal efficiency for debris dropped to 30% as did the efficiency for low specific surface fibres. It will be noted that the consistency of the overflow and underflow fractions were substantially the same.

When the present invention was practiced feeding at 2% consistency and adding dilution water at about 45 U.S. gallons per minute (half for each of the slits) the debris separating efficiency returned to the normal operation as did the efficiency for separating of specific surface fibres.

TABLE I

| Consistency (% O.D.) | | | Dilution | Percent | Average Removal Efficiency | |
|---|---|---|---|---|---|---|
| Feed | Over-flow | Under-flow | Water Flow (USGPM) | Reject Rate | De-bris | Low Specific Surface Fibres |
| 0.55 | 0.5 | 0.9 | 0 | 30 | 43 | 39 |
| 2.0 | 2.0 | 2.0 | 0 | 30 | 30 | 30 |
| 2.0 | 1.9 | 1.0 | 45 | 30 | 43 | 39 |

Thus with the high consistency feed, the cleaning efficiency of the hydrocyclone does not significantly change, yet the consistency of the stock in the accepted fraction remained at about 2% thus reducing substantially the requirements for thickening the stock for storage.

EXAMPLE 2

Using the 6 inch diameter hydrocyclone of example 1 experiments were done with a hardwood bleached Kraft pulp containing approximately 1% of small size dirt.

The efficiency of the cleaner was calculated by counting the number of specs on laboratory handsheets using the dirt estimation chart (Tappi standards T 213 and T 437) in the feed and accepted streams. The ratio of the number of particles of a given area per grams of pulp in accepts ($N_a$) and feed ($N_f$) indicates the cleanliness of the accepted stock.

The table below summarizes the results obtained at a reject rate of 10% at low feed consistency and at high feed consistency with and without dilution water for two classes of dirt particles.

| Consistency (% O.D.) | | | Dilution | $N_a/N_f$ for dirt of area | |
|---|---|---|---|---|---|
| Feed | Over flow | Under flow | Water Flow (USGPM) | 0.15mm² to 0.3mm² | 0.03mm² to 0.6mm² |
| 0.54 | 0.50 | 1.4 | 0 | 0.52 | 0.48 |
| 1.7 | 1.6 | 3.9 | 0 | 0.62 | 0.53 |
| 1.7 | 1.5 | 1.0 | 26 | 0.52 | 0.48 |

Modifications can be made without departing from the spirit of the invention as defined in the appended claims.

I claim:

1. A method for cleaning pulp comprising, feeding a slurry of pulp at a pulpable consistency of at least 1% to a hydrocyclone means, said hydrocyclone means having a tangential inlet, a conical section, base outlet, apex outlet and tangential dilution water inlet means in said conical section adjacent said apex outlet, continuously ejecting a reject fraction through said apex outlet, injecting dilution water tangentially to said cyclone means through said dilution water inlet means at a velocity substantially equal to the velocity of pulp in said hydrocyclone means at said dilution water inlet means, substantially all of said dilution water being ejected through said apex outlet as a portion of said reject fraction and in a quantity sufficient to maintain the consistency of said reject fraction no greater than 1.1% and providing a dilution zone extending between said dilution water inlet means and said apex outlet for a distance such that classification occurs at an efficiency substantially equivalent to the efficiency of a similar hydrocyclone without dilution water but operated at a feed consistency of about 0.6%, ejecting an accept fraction through said axial base outlet said accept fraction having a consistency substantially equal to said feed consistency thereby to provide a cleaned accept pulp leaving said cleaner through said base outlet at a consistency substantially the same as the feed.

2. A method as defined in claim 1 further comprising, diluting said rejected fraction to a consistency of less than 0.5%, cleaning said diluted rejected fraction in a second hydrocyclone means and returning accepts issuing from said second hydrocyclone means to form part of said feed to said first hydrocyclone means.

3. A method as defined in claim 1 wherein said consistency of said pulp fed to said hydrocyclone means is about between 1 and 2.5%.

4. A method as defined in claim 3 wherein said accepted fraction from said hydrocyclone means is fed directly to storage.

5. A hydrocyclone for directly providing an accepted pulp fraction at a consistency of at least 1% from a wood pulp suspension fed thereto at a pumpable feed consistency of at least 1% said hydrocyclone comprising, a conical section having a base with an axial base outlet, a tangential inlet means adjacent said base and an apex outlet at the end of said conical section remote from said base, said base outlet providing an outlet for said accept pulp fraction and said apex outlet providing an outlet for a reject fraction, said base being of a diameter of between 3–15 inches, said conical section having a cone angle no greater than 12° and no less than 3°, the action of said pulp suspension as it traverses said cleaner automatically defining a line of zero axial velocity in said conical section, a tangential dilution water inlet means through said conical section adjacent but spaced a distance from said apex outlet, a side of said tangential dilution water inlet adjacent said axis of rotation being substantially no closer to the longitudinal axis of said conical section than said line of zero axial velocity to ensure that dilution water entering said conical section through said dilution water inlet dilutes stock in the region between said line of zero axial velocity and the periphery of said conical section, the dimension of said tangential dilution water inlet being such that when dilution water is injected at a velocity substantially equal to the velocity of stock in said cleaner at said dilution water inlet means an amount of dilution water is injected to ensure that said reject fraction is at a consistency of no greater than 1.1% when said pulp suspension is fed to said inlet means at said pumpable feed consistency of at least 1%, said distance between said dilution water inlet means and said apex outlet ensuring substantially all of said dilution water forms part of said reject fraction and providing a dilution zone extending axially of said conical section for said distance such that classification to clean the pulp occurs at an efficiency substantially equivalent to the efficiency of a similar hydrocyclone without dilution water but operated at a feed consistency of about 0.6%, thereby to provide said accepted pulp fraction at a consistency substantially equal to the feed consistency.

* * * * *